United States Patent [19]

Mantelet

[11] Patent Number: 4,517,454

[45] Date of Patent: May 14, 1985

[54] ELECTRIC HEATING ELEMENT, AND A HOT PLATE EQUIPPED WITH THE HEATING ELEMENT

[75] Inventor: Jean Mantelet, Paris, France

[73] Assignee: Cuisi-Technic S.a.r.l., Paris, France

[21] Appl. No.: 556,169

[22] Filed: Nov. 29, 1983

[30] Foreign Application Priority Data

Mar. 31, 1983 [FR] France ..... 83 05377
Dec. 9, 1983 [FR] France ..... 83 14469

[51] Int. Cl.[3] ..... H05B 3/68

[52] U.S. Cl. ..... 219/455; 219/459; 219/462; 219/466; 219/467; 219/540; 219/541; 219/544; 219/552; 338/240

[58] Field of Search ..... 219/445, 446, 447, 455, 219/458, 459, 461, 462, 463, 465, 466, 467, 468, 540, 541, 544, 547, 552; 338/240, 241, 242; 174/78, 41

[56] References Cited

FOREIGN PATENT DOCUMENTS 937606 8/1948 France .

*Primary Examiner*—Volodymyr Y. Mayewsky
*Attorney, Agent, or Firm*—Young & Thompson

[57] ABSTRACT

An electrical heating element comprises a resistance wire embedded in a refractory material contained in a tubular casing.

The casing has the shape of a closed ring which has a U-shaped cross-section. The cross-section is closed by a cover, the opposite sides of the cover being covered by the curved arms of the "U" of the casing.

This heating element can be used in the construction of hot plates for domestic appliances such as cookers or cooking surfaces.

8 Claims, 17 Drawing Figures

Fig 3
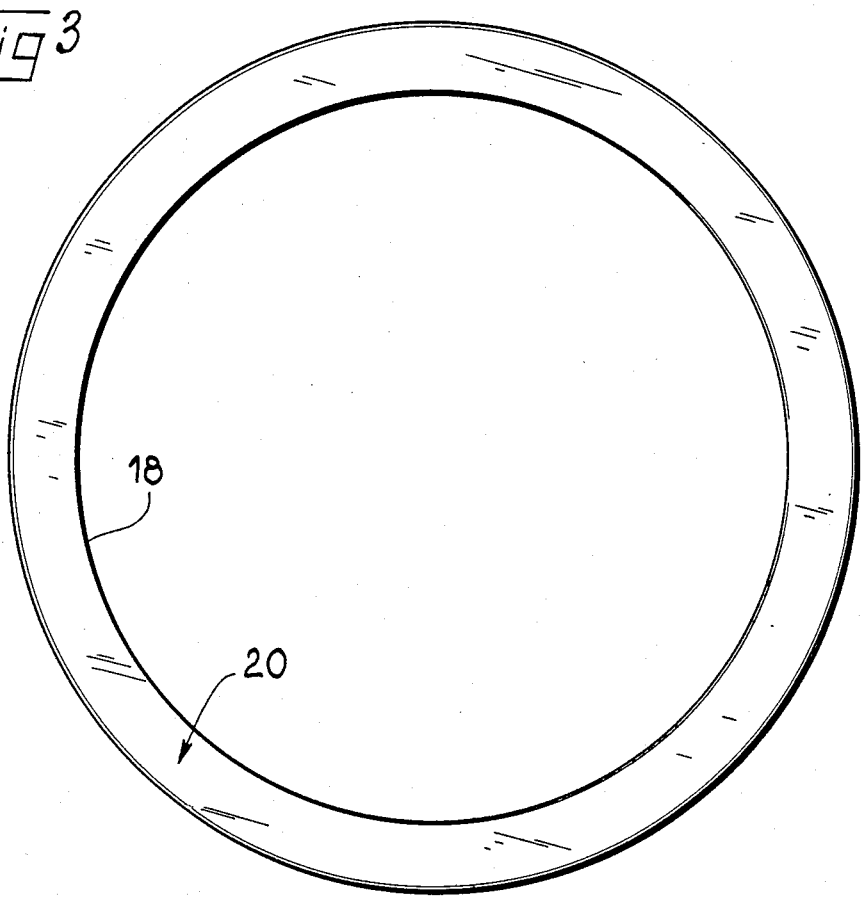
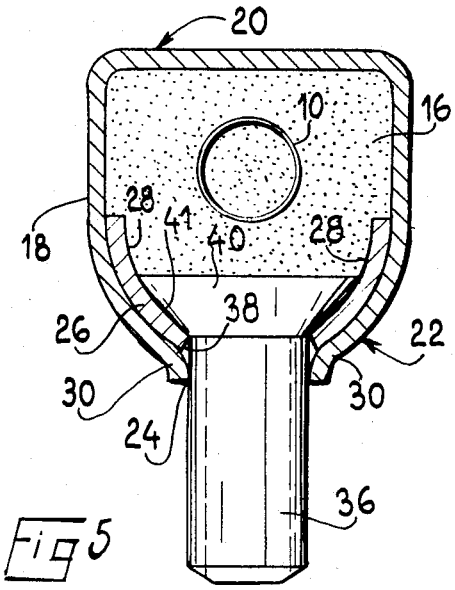
Fig 5
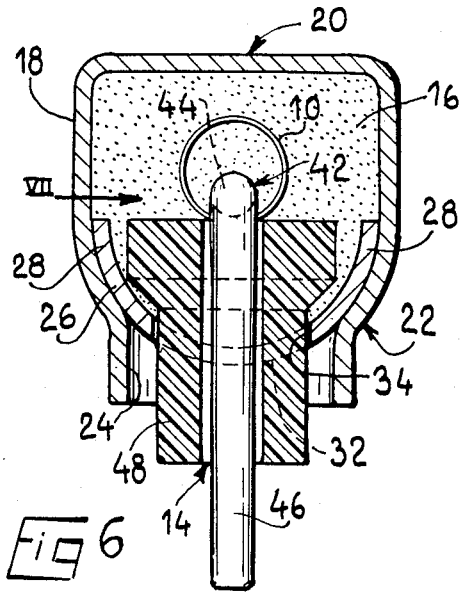
Fig 6

ELECTRIC HEATING ELEMENT, AND A HOT PLATE EQUIPPED WITH THE HEATING ELEMENT

BACKGROUND OF THE INVENTION

The present invention relates to electric heating elements and in particular to those intended to equip the hot plates of domestic appliances such as cookers, portable cookers or cooking surfaces.

It relates, more particularly, to heating elements which comprise a resistance element provided with two end terminals and embedded in a refractory material contained in a sheet-metal tubular casing extending tangentially with respect to a plane.

A heating element of this kind is described, for example, in French Pat. No. A 937 606. In this known heating element, the tubular casing consists of a single tube which is suitably shaped in a horizontal plane, i.e. in the heating plane, and the end terminals of the resistance wire are arranged respectively at both ends of this tube. As a result, these ends of the tube are curved downwardly to enable the electrical connections to be made. This construction has the disadvantage that in the horizontal heating part there exists a fairly expensive angular zone which is not heated.

SUMMARY OF THE INVENTION

It is an object of the invention to overcome this known disadvantage.

According to the present invention there is provided an electric heating element comprising a sheet-metal tubular casing in the shape of a closed ring extending tangentially to a heating plane refractory material contained within said tubular casing, and a resistance element having first and second end terminals embedded in said refractory material, wherein said casing has first and second opposed, axially spaced faces, the first face extending tangential to said heating plane over the entire circumferential extent of the casing, and an endless slit extneds in the second face around the casing, and wherein a sheet-metal cover is arranged within the casing to close the slit, an area of the cover adjacent the slit having at least one gap through which said end terminals project, and wherein at least one metal lug is carried by said cover and projects outwardly of the casing to constitute both fixing means for the heating element and a connector for earthing the casing.

The present invention ensures continuity of the heating over the entire length of an annular path. Furthermore, the electrical connections and fixing of the heating element on a frame or other support are greatly facilitated.

The invention also extends to a hot plate for heating cooking vessels equipped with at least one heating element as defined above, the casing of the heating element being arranged horizontally, with the end terminals and the metal lug extending downwardly, and the upper face of the casing forming a heating plane on which the bottoms of the cooking vessels are directly placed.

BRIEF DESCRIPTION OF THE DRAWINGS

Embodiments of the present invention will hereinafter be described, by way of example, with reference to the accompanying drawings, in which:

FIG. 3 shows a plan view from above of the heating element of FIG. 1;

FIG. 5 shows, on an enlarged scale, a section of the heating element taken along line V—V of FIG. 2;

FIG. 6 shows, on an enlarged scale, a section of the heating element taken along line VI—VI of FIG. 2;

DESCRIPTION OF A PREFERRED EMBODIMENT

Figure 1:
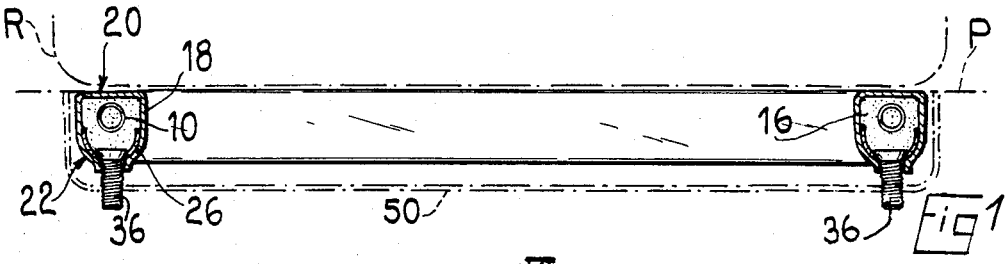
FIG. 1 shows a vertical section of an electrical heating element of the invention.
Figure 2:
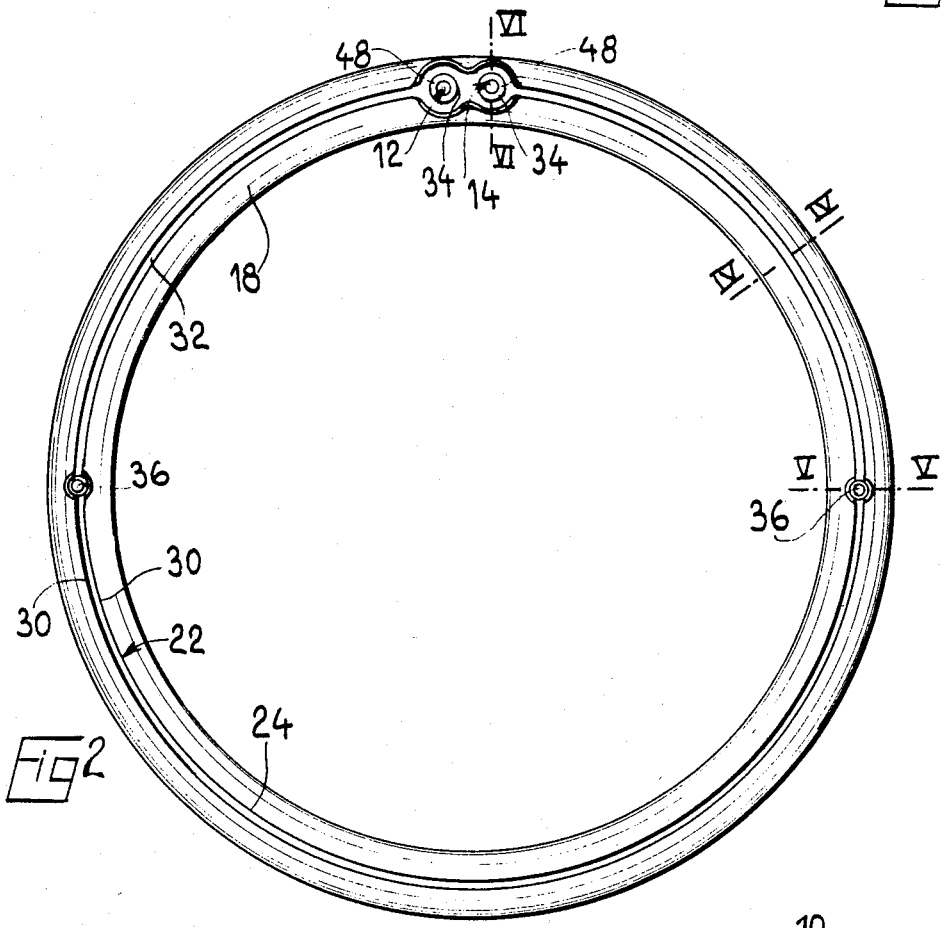
FIG. 2 shows a plan view from below of the heating element of FIG. 1.
Figure 4:
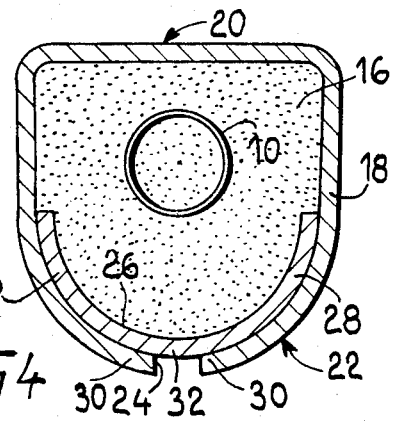
FIG. 4 shows, on an enlarged scale, a section of the heating element taken along line IV—IV of FIG. 2.

The electrical heating element shown in FIGS. 1 to 7 comprises a helicoidal resistance wire 10 provided with two end terminals 12 and 14. The helicoidal wire 10 is embedded in a refractory material 16 contained in a sheet-metal tubular casing 18 and extending tangentially with respect to a heating plane P.

The tubular casing 18 has the shape of a circular closed ring, one face 20 of which is tangential to the plane P over the entire circumferential extent of the ring. The other face 22 of the ring, opposite to the face 20, has a slit 24 extending over the entire circumferential extent of the ring and closed by a sheet-metal cover 26. The cover 26 is within the casing 18 and its opposite sides 28 are covered by the opposed edges 30 of the slit 24. That area 32 of the cover 26 which is adjacent the slit 24 is provided with two gaps 34 for the terminals 12 and 14 and carries two metal lugs 36 which project outwardly of the casing 18 and which are situated at two diametrically opposite points of the ring. The lugs 36 not only provide parts for fixing the heating element, but also provide connectors for earthing the tubular casing 18.

The tubular casing 18 has a substantially U-shaped cross-section, the flat base 20 of which is situated in the plane P. The cross-section of the cover 26 is substantially an arc of a circle, the concavity of which faces towards the interior of the casing 18. The arms of the "U" of the casing are curved towards each other on the arc-shaped cover 26.

As can be seen more clearly from FIG. 5, each metal lug 36 is formed by a threaded shank which passes through a hole 38 in the cover 26 and which has an enlarged head 40 situated on the inner face of this cover and thus resting on the edge of the hole 38. To ensure good electrical contact between the shank 36 and the cover 26, the head 40 is preferably soldered to the cover 26 as indicated at 41.

Figure 7:
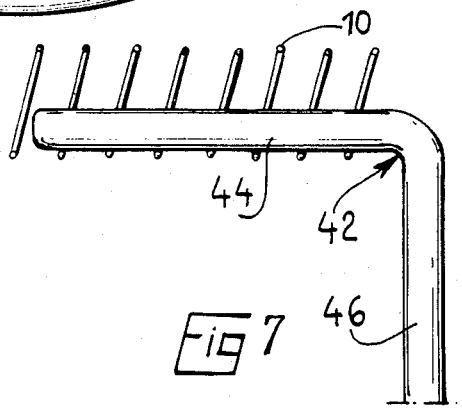
FIG. 7 shows a pin forming part of an end terminal seen in the direction of the arrow VII of FIG. 6.

As is shown in FIGS. 6 and 7, each of the end terminals 12 and 14 has an L-shaped pin 42, one of the arms 44 of which is surrounded by the end of the helicoidal wire 10 and soldered thereto. The other arm 46 of each pin 42 passes through an insulator 48 arranged in the gap 34 of the cover 26.

When a heating ring thus formed is incorporated in a hot plate intended to heat cooking vessels R with a flat bottom (FIG. 1), the ring is arranged horizontally within a support 50, with the end terminals 12 and 14 and the lugs 36 extending downwardly. The upper face 20 of the ring forms a heating surface on which the bottoms of the vessels R are placed. The lugs 36 are used not only to fix the ring in the support 50, but also to electrically connect the casing 18 to the earth of the support 50.

FIGS. 8 to 17 illustrate a hot plate of this kind which is equipped with two heating rings 52 and 53 arranged concentrically in the same support 50, with their upper surfaces 20 situated in the same horizontal plane.

Figure 8:
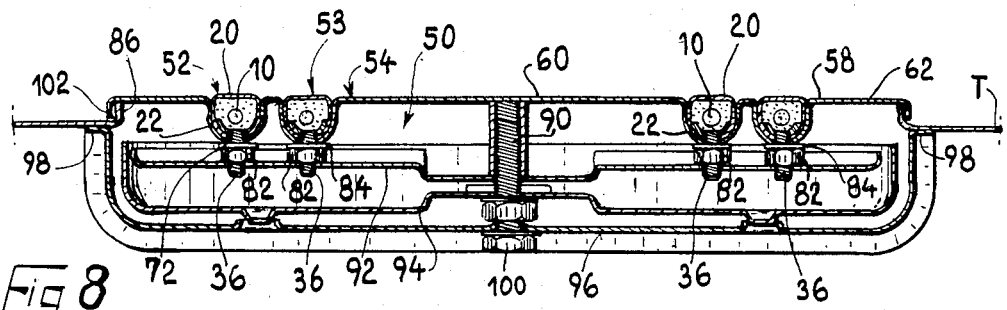
FIG. 8 shows a vertical section of a hot plate equipped with two rings, the section being taken along line VIII—VIII of FIG. 10.
Figure 9:
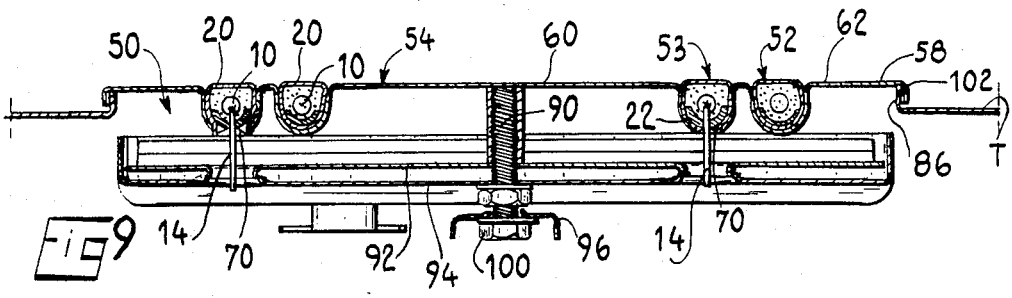
FIG. 9 is a vertical section of the hot plate along line IX—IX of FIG. 10.
Figure 11:
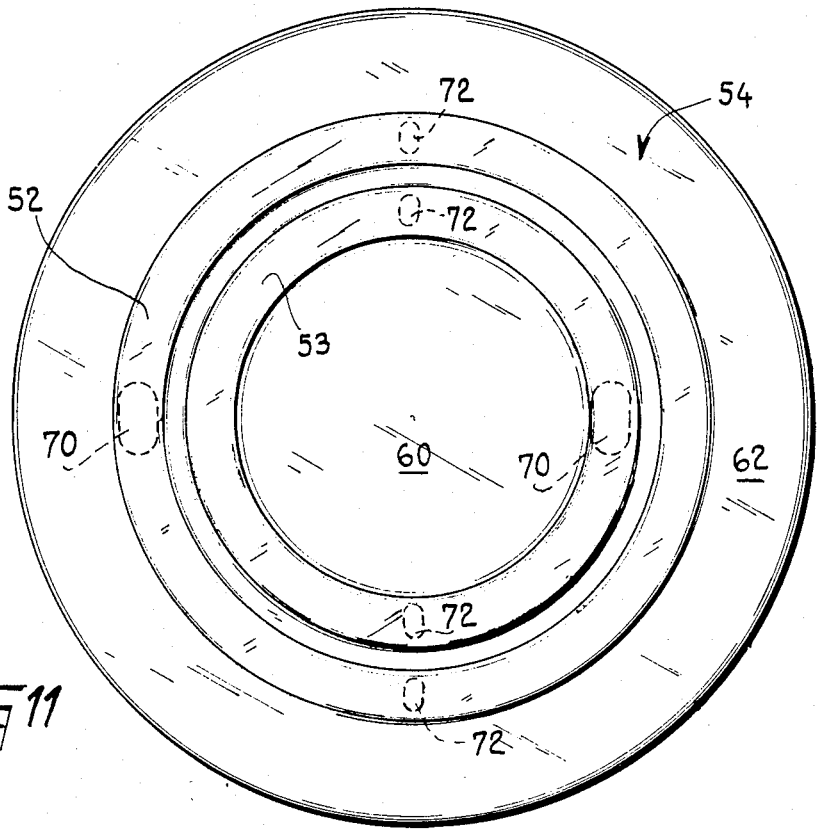
FIG. 11 is a top view of the hot plate.
Figure 12:
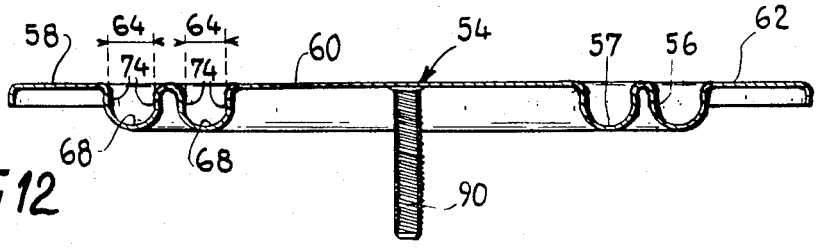
FIG. 12 shows a vertical section of a metal plate of the hot plate.
Figure 13:
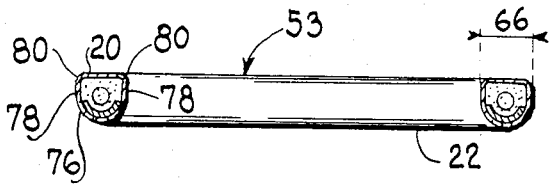
FIG. 13 is a section of one of the rings of the hot plate.

As can be seen in FIG. 12, the support 50 comprises a metal plate 54 which is intended to be used horizontally and in which two annular grooves 56 and 57 are chased. The grooves open upwardly and receive the heating rings 52 and 53, respectively. As can be seen more clearly from FIG. 11, the plate 54 is circular, and its upper face 58 has a central region 60 within the pair of rings 52, 53 and a peripheral region 62 surrounding the rings 52, 53. Both the central region 60 and the peripheral region 62 are flat and smooth. An enamel coating is provided on the inner faces of the annular grooves 56 and 57 and all over the rest of the upper face 58 of the plate 54. Each groove 56, 57 has a depth such that the upper face 20 of the rings 52, 53 projects slightly above the upper face 58 of the plate 54 (FIGS. 8 and 9), whilst the width 64 of each groove 56, 57 (FIG. 12) is substantially the same as the width 66 of each ring 52, 53 (FIG. 13), such that there are practically no gaps between the edges of each groove and the peripheral edges of each ring (FIGS. 8 and 9). Each groove 56, 57 has in its bottom 68 an aperture 70 through which the electrical terminals 12 and 14 pass, and two holes 72 for receiving the lugs 36 (see broken lines in FIG. 11).

The cross-section of each of the grooves 56, 57 (FIG. 12) comprises a semi-circular portion which forms the bottom 68 of the groove and which is connected to two vertical rectilinear portions 74 forming the sides of the groove. Each ring 52, 53 has a cross-section whose general shape (FIG. 13) is complementary to that of the respective groove and comprises a semi-circular bottom portion 76, two lateral rectilinear portions 78 and a flat rectilinear portion 20 which is connected by two slightly rounded portions 80 to the lateral portions 78. In order to secure each ring 52, 53 in its respective groove 56, 57, each fixing lug 36 is provided with a nut 82 and a washer 84 (FIG. 8) which ensure that the bottom portion 76 of the rings rests firmly against the bottoms 68 of the grooves 56, 57.

Figure 10:
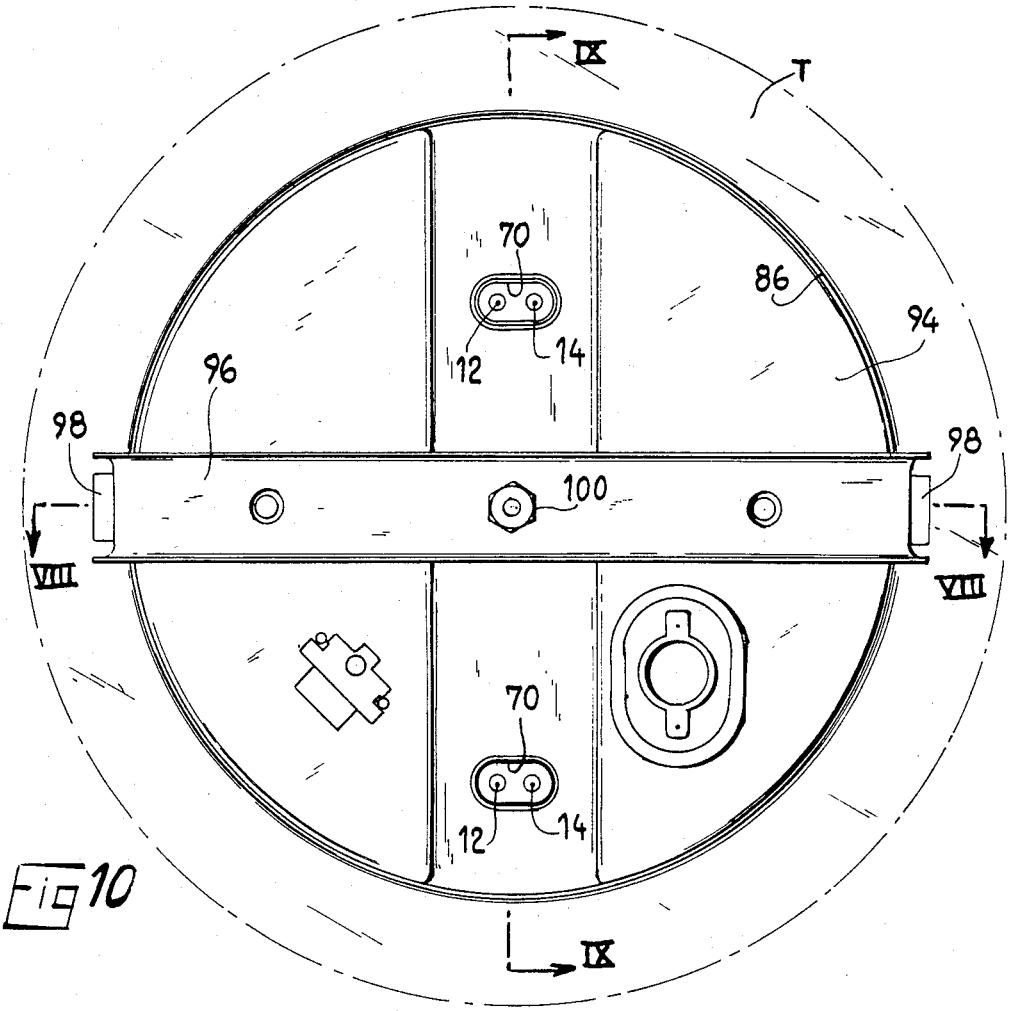
FIG. 10 is a bottom view of the hot plate.

The hot plate thus formed is shown in FIGS. 8 to 10 mounted within an opening 86 in the upper wall T of a cooking surface. The lower face of the plate 54 carries, in its central area, a threaded shank 90 which extends downwardly. Two reflectors 92 and 94, each having the general shape of a bowl with its concavity facing upwardly are fixed onto the shank 90 together with a diametrical stirrup 96. The ends 98 of the stirrup are arranged to rest underneath the edge of the opening 86 and the central region of the stirrup 96 is subjected to an upwardly directed tensile stress by means of a nut 100 screwed onto the shank 90. The hot plate can thus be secured in the opening 86 by pinching the wall T between an external wall 102 of the plate 54 and the ends 98 of the stirrup 96.

It will be appreciated that once the hot plate has been fixed in the cooking surface, any spillage which occurs during cooking falls onto the plate 54 and is unable to penetrate beneath the rings 52 and 53. Cleaning of the hot plate therefore does not present any particular problems.

Figure 14:
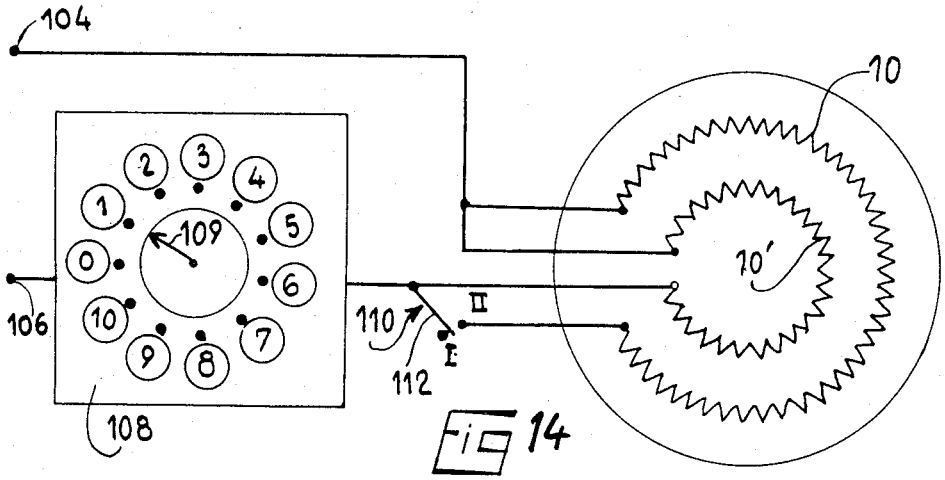
FIG. 14 shows a circuit diagram of a supply circuit for the rings.

As shown in the circuit diagram of FIG. 14, the resistances of the heating rings 52 and 53, which are denoted as 10 and 10' respectively, are supplied from mains supply terminals 104 and 106 by way of a supply circuit comprising an electronic switch 108 and a commutator 110. The switch 108 is connected to the supply terminal 106 and is arranged to provide an intermittent supply at regular intervals i. Each pulse of power has a period d which can be adjusted, according to the average power required, by means of a pointer 109, which can be moved opposite graduations numbered from 0 to 10. The commutator 110 has an armature 112 which is connected to the electronic switch 108 and which is movable between two positions, i.e. a first position in which the armature 112 comes into contact with a stud I and in which only the resistor 10' of the ring 53 is supplied, and a second position in which the armature comes into contact with a stud II and in which the resistors 10 and 10' of the two rings 52 and 53 are supplied in parallel.

Figure 15:
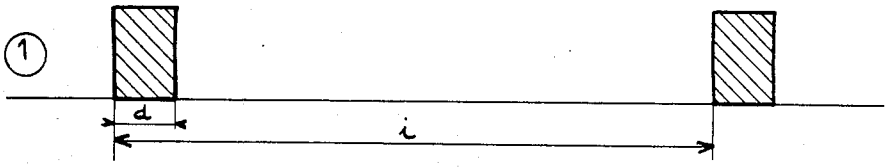
FIGS. 15, 16 and 17 are diagrams illustrating the intermittent supply to the rings for three different adjustments of the supply circuit of FIG. 14.
Figure 16:
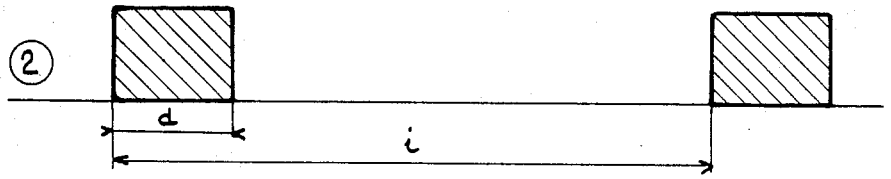
Figure 17:
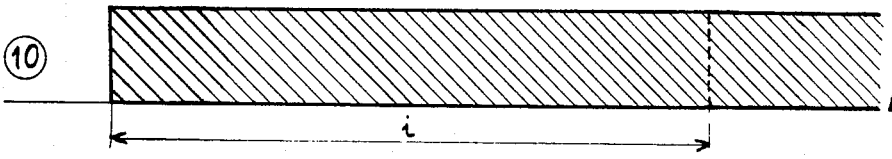

In order to explain the operation of the electronic switch 108, FIGS. 15, 16 and 17 show diagrams illustrating the supply to the rings, for three different adjustments of the pointer 109, i.e.: pointer 109 placed opposite graduation 1 (FIG. 15), opposite graduation 2 (FIG. 16) and opposite graduation 10 (FIG. 17). FIGS. 15 and 16 show, for two different periods d, that the average power supplied to the rings 52 and 53 is proportional to the ratio between the period d and the interval i. As for FIG. 17, it shows the adjustment for a continuous, i.e. uninterrupted, supply.

I claim:

1. A hot plate for heating cooking vessels, equipped with at least one electric heating element in the shape of a closed ring (52, 53) arranged horizontally in a support (50) and having an upper face (20) forming a heating plane (P) on which the bottoms of the cooking vessels (R) are directly placed, the lower face (22) of the ring carrying electric end terminals (12, 14) and at least a fixing metal lug (36), said terminals and lug extending downwardly, said support (50) comprising a metal plate (54) arranged horizontally in which an annular groove (56, 57) is chased, said groove opening upwardly and receiving the heating element (52, 53), the depth of the groove being such that the upper face (20) of the heating element projects slightly above the upper face (58) of the plate (54), and the width (64) of the groove being substantially the same as the width (66) of the heating element such that there are substantially no gaps between the edges of the groove and the peripheral edges of the heating elements, at least one aperture (70) through which the end terminals (12, 14) extend being provided in the bottom of the groove, and at least one hole (72) for receiving the metal lug being provided in the bottom of the groove.

2. A hot plate according to claim 1, wherein the metal plate has an enamel coating on the inner faces of the annular groove (56, 57) and all over the rest of its upper face (58).

3. A hot plate according to claim 1, wherein the cross-section of the groove (56, 57) comprises a substantially semi-circular portion which forms the bottom (68) of the groove and which is connected to two vertical rectilinear portions (74) forming the sides of the groove, and wherein the heating element has a cross-section with a complementary general shape and comprising a semi-circular bottom portion (76), two lateral rectilinear portions (78) and a flat rectilinear upper portion (20) which is connected by two slightly rounded portions (80) to the said lateral portions (78).

4. A hot plate according to claim 3, wherein the heating element comprises a sheet-metal tubular casing (18) in the shape of a closed ring whose upper surface defines the heating plane (P), electrically insulating refractory material (16) contained within said tubular casing, and a resistance element (10) having first and second terminals (12, 14) embedded in said refractory material (16), said casing having first and second opposed, axially spaced faces, the first face (20) lying in said heating plane (P) over the entire circumferential extent of the casing, and an endless slit (24) extending in the second face around the casing, a sheet-metal cover (26) within the casing to close the slit, an area (32) of the metal cover adjacent the slit having at least one gap (34) through which said end terminals project, said end terminals being electrically insulated from the metal cover and the metal casing, at least one metal lug (36) carried by said cover and projecting outwardly of the casing to constitute both fixing means for the heating element and a connector for earthing the casing, the tubular casing (18) having a substantially U-shaped cross-section, said first face (20) comprising a flat base of said U-shaped cross-section and being situated in said heating plane (P), and the cover (26) in cross-section being substantially an arc of a circle, the concavity of which faces toward the interior of the casing (18), the arms of the "U" of the casing being curved toward each other on the cover.

5. A hot plate according to claim 1, wherein two concentric heating elements (52, 53) are arranged in the support, the upper faces (20) of the elements extending in the same heating plane.

6. A hot plate according to claim 5, wherein the metal plate (54) is circular, and the upper face (58) of said plate has a flat and smooth central part (60) within the elements, and a flat and smooth peripheral region (62) surrounding the elements.

7. A hot plate according to claim 5, further comprising a supply circuit for the heating elements, said circuit comprising an electronic switch (108) arranged to provide an intermittent supply at regular intervals (i) having a period (d) which can be adjusted, and a commutator (110) movable between a first position in which only the central heating element is supplied, and a second position in which both elements are supplied.

8. A hot plate according to claim 1, wherein a downwardly extending shank (90) is carried by the central area of the lower face of the metal plate (54), and a first and a second reflector (92, 94), each shaped substantially as a bowl with its concavity facing upwardly, are fixed on said shank, and wherein a diametrical stirrup (96) arranged to fix the hot plate in an opening (86) of a cooking surface is also fixed on to said shank.

* * * * *